United States Patent [19]

Justice

[11] Patent Number: 4,805,655

[45] Date of Patent: Feb. 21, 1989

[54] PORTABLE AWNING

[76] Inventor: Craig A. Justice, 90 Cartwright Dr., Bonaire, Ga. 31005

[21] Appl. No.: 157,602

[22] Filed: Feb. 18, 1988

[51] Int. Cl.[4] ..... E04H 15/04

[52] U.S. Cl. ..... 135/90; 135/901

[58] Field of Search ..... 135/90, 901; 182/187, 182/188; 248/218.4, 219.4

[56] References Cited

U.S. PATENT DOCUMENTS

| | | | |
|---|---|---|---|
| 3,116,808 | 1/1964 | Riley | 135/90 |
| 3,485,320 | 12/1969 | Jones | 182/187 X |
| 4,168,765 | 9/1979 | Ferguson et al. | 182/187 X |
| 4,248,095 | 8/1981 | Norton | 135/90 |
| 4,321,983 | 3/1982 | Nelson | 182/188 X |
| 4,410,066 | 10/1983 | Swett | 182/187 X |
| 4,458,707 | 7/1984 | Lindaman | 135/90 |
| 4,505,286 | 3/1985 | Madion | 135/90 |
| 4,549,633 | 10/1985 | Merritt | 182/187 X |
| 4,605,097 | 8/1986 | Maxwell | 182/187 X |
| 4,722,421 | 2/1988 | Hilbert | 182/187 |
| 4,723,630 | 2/1988 | Wolford et al. | 182/187 X |
| 4,726,447 | 2/1988 | Gibson et al. | 182/187 X |
| 4,739,785 | 4/1988 | Poulson | 135/90 |

*Primary Examiner*—J. Karl Bell

*Attorney, Agent, or Firm*—Jones, Askew & Lunsford

[57] ABSTRACT

Portable awning apparatus for temporary attachment to uprights such as tree trunks or the like. The awning apparatus includes a triangular frame having a pair of side members which enclose a tree trunk, and an end member spaced outwardly from the tree trunk. A support member interconnects the two side members at a selectively adjustable distance from the apex of the triangular frame, thereby accommodating tree trunks of different sizes and permitting adjustable tilt of the awning on the tree trunk. A flexible cover extends backwardly from the end member and secures to the tree. The entire awning folds to a relatively compact and easily carryable package when not in use.

9 Claims, 3 Drawing Sheets

PORTABLE AWNING

FIELD OF INVENTION

This invention relates in general to portable awnings, and relates in particular to portable awning apparatus for temporary mounting on a tree trunk or other upright support.

BACKGROUND OF THE INVENTION

Hunters and others engaged in various outdoor activities often stand or sit outdoors in a relatively confined location. For example, a hunter may stand alongside a tree near a location where deer or other game may appear. The tree provides natural cover for the hunter, and in many cases the hunter is elevated above the ground in a platform or tree stand supported by a suitable tree. The hunter in these situations remains relatively exposed to rain in inclement weather, and may also lack any significant shade during hot, sunny days. The tree itself usually is poor protection from the elements, particularly in a hard rain or prolonged drizzle where the tree leaves become thoroughly soaked and rain penetrates whatever natural canopy those leaves provide. Moreover, most seasonal hunting takes place in the fall of the year, a time when deciduous trees have shed their leaves. Thus, a hunter positioned beneath those trees, or on a tree stand mounted therein, can count on getting wet during rainy days and may receive little natural shade during sunny days.

Any portable awning suitable for practical use by a hunter or other person outdoors must be relatively lightweight and easily carryable, preferably by one person. A hunter, for example, is already burdened by carrying a gun, a tree stand, and ammunition and other supplies for the day; any awning or other personal shelter device should therefore not add significant weight to the burden, and should readily fold or collapse to a package easily managed by one person hiking through forest or other rough terrain. Moreover, a practical individual shelter or awning should quickly and easily be mountable to trees of various sizes by a single individual, preferably without using nails or other fasteners embedded into the tree and without rquiring tools for the purpose. The portable awning should offer a degree of adjustability for optimizing water run-off during rainy conditions and maximizing the shade available to the user during sunny weather.

Portable shelter devices are known in the prior art. For example, U.S. Pat. No. 4,458,707 discloses a portable roof somewhat in the nature of an umbrella adapted for fastening to a tree trunk. U.S. Pat. No. 4,505,286 discloses another kind of portable shelter intended for temporary or permanent attachment to a tree trunk. Each of these prior-art shelters is not readily adjustable once positioned on a tree, and neither device has found substantial application.

SUMMARY OF INVENTION

Stated in general terms, the present invention includes a portable support apparatus for an awning-like cover. The support apparatus comprises a frame including a pair of side members each configured to engage the exterior of a tree trunk or other upright on which the support apparatus is temporarily mounted. The side members extend outwardly from the tree trunk and connect to an end member, which the side members must maintain in spaced-apart relation to the tree trunk.

A support member extends between the two side members and engages the tree trunk, so that the support frame extends outwardly from the tree trunk in cantileverfashion, at a substantial angle relative to the tree trunk. The frame supports a cover which shelters from the elements anyone located below the frame.

Stated somewhat more particularly, the side members of the frame connect to spaced-apart locations on the end member, and the side members converge to interconnect each other. The support member spans the two interconnected side members at a distance from the convergence which is only slightly greater than the diameter of the tree trunk at a selected location. The two side members of the frame, together with the support member, thus form a triangular frame section which surrounds the tree trunk and holds the entire frame, including the flexible cover supported by the frame, at a desired vertical location on the tree trunk. The support member is adjustably positioned along the length of the frame side members, so as to accommodate tree trunks of various sizes. Moreover, by adjusting the location of the support member on the side members, the extent to which the frame apparatus tilts downwardly from horizontal is adjusted, to provide sufficient slope for run-off of rain water if necessary.

Stated in further detail, the side members preferably are pivotably connected to the end member, or are otherwise mounted therewith so that the side members and end members can be folded or otherwise juxtaposed in substantially parallel relation when the portable awning apparatus is not being used. With the frame members thus folded, the flexible cover making up part of the awning is then wrapped around the folded frame members, providing a relatively compact package easily manageable by one person. A carrying sling or the like can be attached to the folded apparatus for ease of carrying over extended distances.

Accordingly, it is an object of the present invention to provide an improved portable awning.

It is another object of the present invention to provide a portable awning apparatus readily mountable and demountable from a tree or other upright.

It is still another object of the present invention to provide a portable awning apparatus which is easily foldable to a compact configuration suitable for carrying by one person.

Other objects and advantages of the present invention will become more readily apparent from the following description of a preferred embodiment.

DETAILED DESCRIPTION OF A PREFERRED EMBODIMENT

Figure 1:
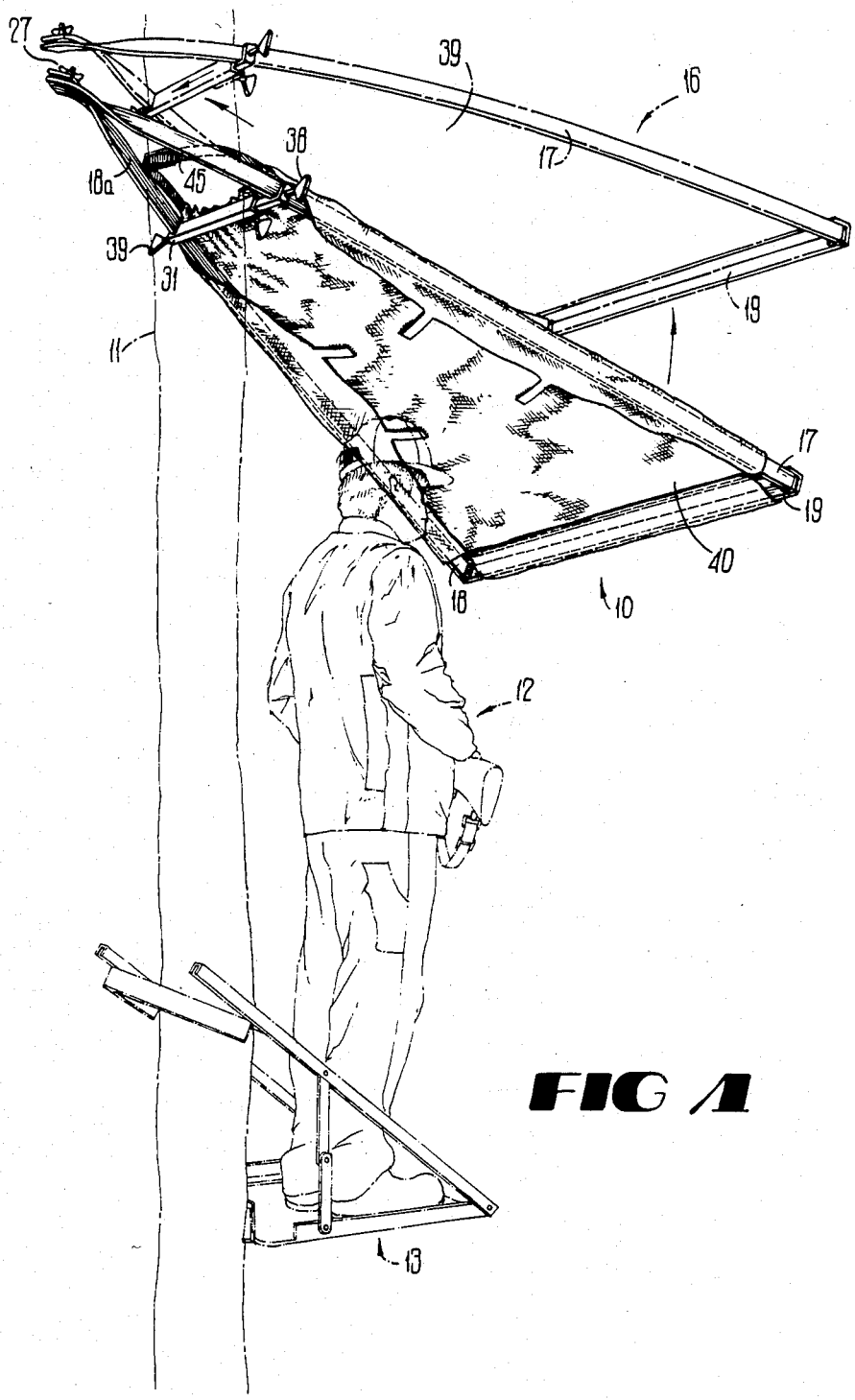
FIG. 1 is a pictorial view showing a portable awning embodying the present invention. The frame portion of the disclosed embodiment is shown therein in broken lines.

Turning first to FIG. 1, there is shown generally at 10 a portable awning according to the disclosed embodiment of the present invention. The awning 10 is shown mounted on the tree trunk 11, a short distance above the hunter 12 standing on the tree stand 13 which also is supported on the tree trunk. The awning 10 is not fastened to the tree, as becomes apparent from the following description. The tree stand 13 forms no part of the present invention and is not further described herein.

Figure 2:
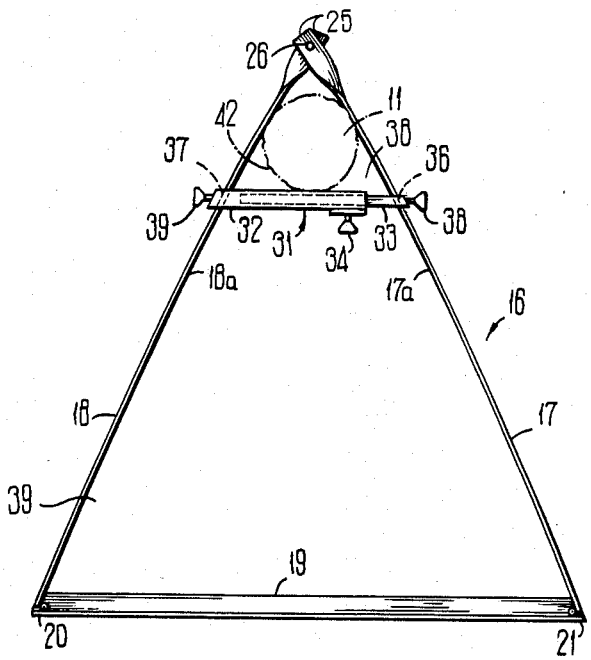
FIG. 2 is a bottom plan view showing the portable awning of FIG. 1 mounted on a tree of relatively small diameter, the flexible cover being omitted for illustrative purposes.
Figure 3:
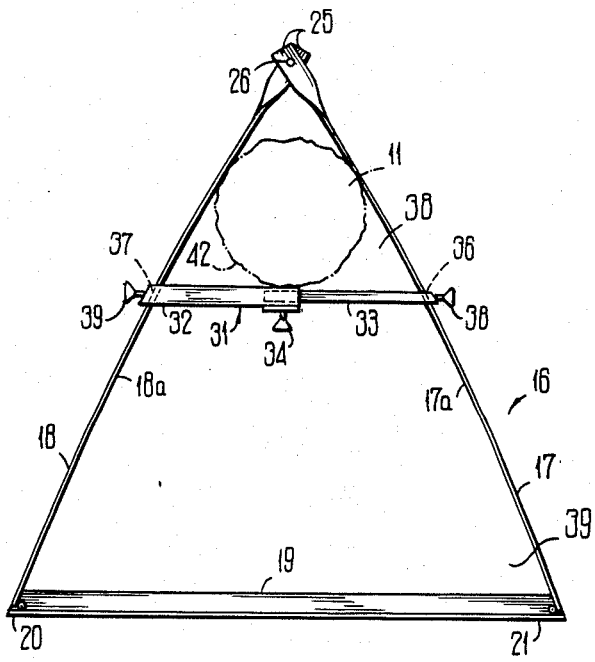
FIG. 3 is a view as in FIG. 2, showing the disclosed portable awning mounted on a tree of relatively larger diameter.

The awning 10 includes a frame assembly 16 best seen in broken lines in FIG. 1, and shown in FIGS. 2 and 3 in solid lines. The frame assembly 16 includes a pair of side members 17 and 18, one end of which is connected to the end member 19 at mutually spaced-apart locations 20 and 21. The end member 19 preferably is substantially resistant to bending and may be fabricated from lightweight metal angle, glass fiber-reinforced plastic composites, or the like. In the disclosed embodiment of the present invention, the end member 19 is made of metal having a right-angle cross section for strength and rigidity. The frame members 17 and 18 are connected at 21 and 20 to the end member 19 by pins forming a hinge connection allowing the two frame members to fold and lie substantially alongside the end member, as explained below in further detail.

The side members 17 and 18 in the disclosed embodiment are fabricated from flat strips of metal aligned so that the flat sides 17*a*, 18*a* confront the surface 26 of the tree trunk 11, thereby maximizing the surface area contact between the side members and minimizing damage to the tree trunk. The side members 17 and 18 each are rotated 90° adjacent their ends 25 remote from the end member 19, allowing the flat ends to overlap each other as seen in FIG. 2. A bolt extends through aligned openings 26 in the flat ends 25, and a wing nut 27 (FIG. 1) engages the bolt to secure together the flat ends in assembly.

A support member 31 engages each side member 17 and 18, and extends between those side members in substantially parallel relation to the end member 19, at a selectively variable distance from the interconnected ends 25 of the side members. The support member 31 comprises a hollow tube 32 open at one end to telescopically receive a rod 33. A fingeradjustable wing bolt 34, near the open end of the hollow tube 32, selectively enters the interior of the hollow tube to engage the outer surface of the rod 33, locking the rod in place relative to the hollow tube and thereby selectively fixing the overall length of the support member 31.

Extending through the rod 33 adjacent its outer end is a rectangular U-shaped slot 36 (FIG. 2) which provides a slidable fit for the side member 17. A similar slot 37 is formed adjacent the outer end of the hollow tube 32, for receiving the other side member 18. The wing bolts 38 and 39 engage threaded openings in the ends of the rod 33 and the hollow tube 32, respectively, and those wing bolts selectively clamp the side members 17 and 18 within the respective slots 36 and 37 to secure the support member 31 to the side members at selected positions from the ends 25.

The frame assembly 16 defined by the two side members 17 and 18 and the end member 19 is substantially triangular in its open position, shown in FIGS. 1–3. The support member 31 positioned on the side members 17 and 18 divides that open frame into a triangular portion 38 which surrounds the tree trunk 11, and a remaining frame portion 39 substantially trapezoidal in shape. A flexible cover 40 extends over at least the trapezoidal portion 39 of the frame assembly, and protects the hunter 12 from exposure to the elements while beneath the awning 10. The cover 40 is preferably fabricated from a lightweight flexible and water-impervious material such as woven or nonwoven fabric or the like. The construction of the cover 40 is further set forth in the working description of the awning 10 which follows.

Figure 4:
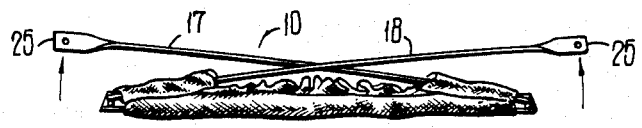
FIG. 4 is a pictorial view showing the disclosed portable awning in folded position, in preparation for unfolding.

In describing the assembly and use of the awning 10, it is assumed the awning initially is substantially folded as shown in FIG. 4. The two side members 17 and 18 thus are disconnected at their ends 25 and are pivoted at 20 and 21 to lie substantially flat alongside the end member 19. The flexible cover 40 is rolled around the end member 19, and the support member 31 (not shown in FIG. 4), previously disconnected from the side members, can be enclosed within the rolled cover. A carrying sling (not shown) is readily attachable to the ends of the folded awning, enabling a person to sling the folded awning over one sholder.

Figure 5:
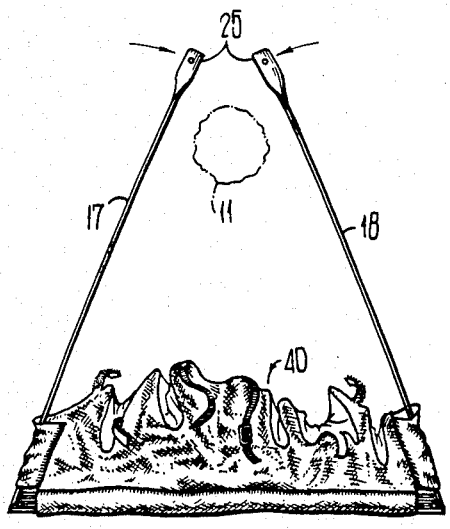
FIGS. 5, 6, 7, and 8 show further stages in unfolding and mounting the portable awning on a tree trunk.
Figure 6:
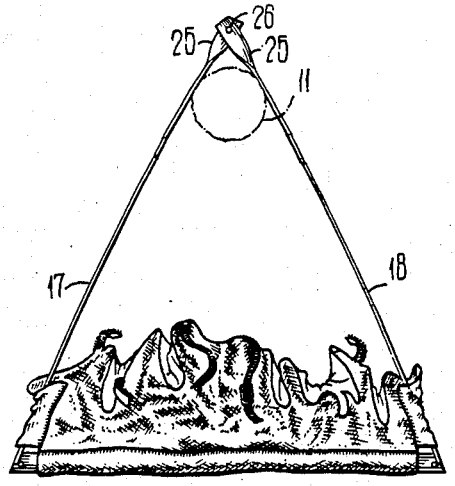

To erect the awning 10, the side members 17 and 18 first are pivoted outwardly relative to the end member 19, to a position where the ends 25 of the side members are substantially separated from each other. The awning apparatus 10 is then positioned around the tree trunk 11, FIG. 5, and the two ends 25 of the side members 17 and 18 are next moved together as indicated by the directional arrows in that figure. When the end members 25 overlap each other as shown in FIG. 6, the bolt and wing nut 25 interconnect the overlapping holes 26 in the end members to secure the overlapping ends.

Figure 7:
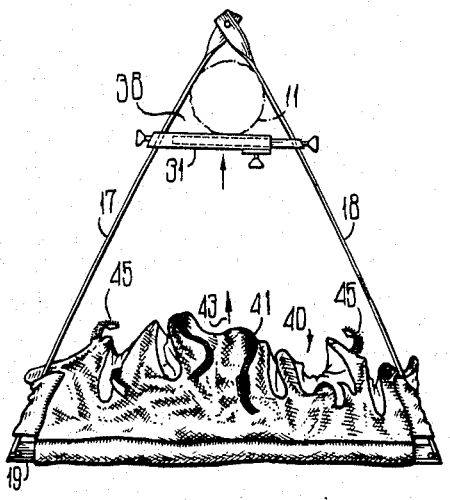

With the sides 17 and 18 thus interconnected to enclose the tree trunk 11, the support member 31 is now attached to the side members. This is accomplished from beneath the awning 10 by placing the support member 31 upwardly to engage the side members 17 and 18 into the slots 36 and 37 of the support member. The wing bolt 34 which interconnects the telescoping rod 33 within the hollow tube 32 of the support member preferably is loosened at this time, so that the rod freely slides within the hollow tube. With the support member 31 thus in place, the awning 10 now can be raised to the desired height and tilt. All three wing bolts 34, 38, and 39 are now tightened, defining the triangular portion 38 surrounding the tree trunk 11. The frame 16 thus is securely positioned on the tree trunk as shown in FIG. 7.

Figure 8:
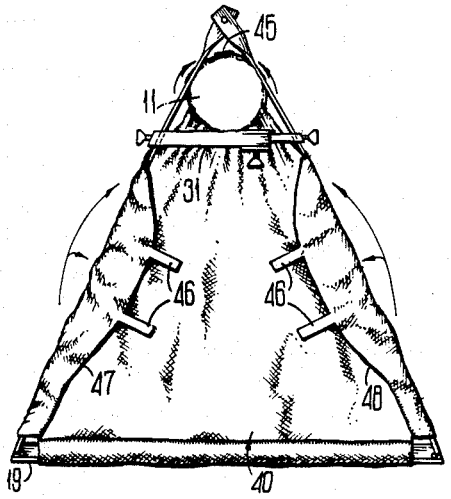

With the frame assembly 16 now in place, the cover 40 next is installed on the frame. This is accomplished by unrolling the cover 40 from the end member 19 while working the forward end 41 of the cover back toward the tree trunk 11, as indicated by the directional arrow 43 in FIG. 7. Straps 45 are attached to the forward end 41 of the cover 40, and these straps are wrapped around the tree trunk 11 as shown in FIG. 8 for securing the full length of the cover fully extended from the end member 19 to the tree trunk. The straps 45 may be a buckled strap, or alternatively may have a hook-and-loop fastener such as Velcro TM material for ease of attachment and removal of the sides 47 and 48 of the cover.

With the cover 40 thus fully extended from the end member 19 of the frame assembly, the sides 47 and 48 of the cover are wrapped over the side members 17 and 18 and the small straps 46 extending outwardly from the sides of the cover are attached to the underside of the cover. The small straps 46 preferably have hook-and-loop surfaces which engage complementary connecting pads affixed to the underside of the cover 40.

With the cover 40 installed as described in the preceding paragraph, the erection and installation of the portable awning 10 is completed. The angle at which the awning declines from horizontal is adjustable by adjusting the position of the support member 31 along the side members 17 and 18, thereby varying the distance between the support member and the interconnected ends 25 of the side members. Increasing that distance increases the angle of tilt downwardly from horizontal. Where the awning 10 is used in rainy weather, the downward tilt of the awning should be increased for improved water run-off, to prevent the water from forming pools on the cover 40 which might possibly leak through the fabric of the cover. In sunny weather, the tilt angle of the awning may preferably be decreased so that the awning is more nearly horizontal, thereby increasing the effective area shaded by the awning.

It will be understood that the flat shape of the side members 17 and 18 in the disclosed configuration provide these side members with a degree of yielding flexibility, particularly along the length of the side members extending from the interconnected ends 25 to the support member 31 clamped onto the side members. This degree of flexibility allows the side members to bend somewhat as the awning tilts downwardly from horizontal when released by the installer. This bending of the side members, and the resulting force of the side members pressing inwardly against the tree trunk 11, increases as the awning 10 tilts downwardly, providing a snug engaging fit of the awning on the tree trunk without driving nails or other fasteners in the trunk. Furthermore, the position of the awning 10 on the tree trunk is easily adjusted by the hunter, simply by tilting the awning upwardly to horizontal and then repositioning on the tree as desired.

It should be understood that the following relates only to a preferred embodiment of the present invention, and that numerous modifications and changes therein may be made without departing from the spirit and scope of the invention as defined in the following claims.

What is claimed is:

1. Portable support apparatus for temporary attachment to an upright such as a tree trunk or the like without dependence on any other device attached to the tree, comprising:

a substantially inflexible end member, a pair of side members each connected to the end member in spaced-apart relation therealong;

the side members extending form laterally outwardly from the end member and mutually converging to interconnect at a point laterally spaced from the end member; and means extending between the side members at a selectively adjustable distance from the convergent point of the side members, so that the means and the portions of the mutually converging side members between the means and the convergent point form a triangle for receiving and gripping the upright in a range of diameters, so that the converging side members firmly grip the trunk and support the apparatus at a selected vertical location on the trunk while the side members extend outwardly from the trunk at a substantial angle relative to horizontal and with the end member located in laterally spaced relation to the trunk.

2. Apparatus as in claim 1, further comprising:

cover means covering the region bounded by the means, the side members, and the end member laterally spaced from the trunk, so as to provide shelter from the elements to a region beneath the support apparatus.

3. Apparatus as in claim 2, wherein the cover means comprises a flexible fabric panel.

4. Apparatus as in claim 1, wherein:

the means extending between the side members is connected to the side members and is selectively variable in length, so that the side members extend outwardly from the trunk and tilt downwardly from horizontal at an angle depending on the size of the upright and on the selected length of said means.

5. Apparatus as in claim 4, wherein:

said means comprises a first support member telescopically associated with a second support member;

one of said support members being connected to one side member at a selectively variable location thereon, and the other support member being connected to the other side member at a selectively variable location thereon; and means selectively securing the first support member to the second frame member so as to prevent relative movement of the support members.

6. Portable awning apparatus for temporary attachment to a tree trunk, comprising:

a pair of side members each having a proximal end and a distal end;

means selectively interconnecting the proximal ends of the side members;

an end member;

means pivotably connecting the distal ends of the side members at spaced apart locations on the end member whereby the side members when thus interconnected diverge outwardly from the proximal ends to the spaced-apart locations, and when not interconnected can pivot to lie substantially alongside the end member for storing or carrying the awning apparatus;

a support member selectively adjustable in length and interconnecting the side members at a selectively variable distance from the interconnected proximal ends, so that the support member and portions of the diverging side members form a triangular frame surrounding the tree trunk and supporting the awning apparatus with the end member in spaced relation a distance outwardly from the tree trunk and with the diverging side members tilted downwardly from horizontal to firmly grip the trunk and support the apparatus thereon; and a flexible cover extending from the end member at least to the support member and sheltering from the elements anyone located below the cover.

7. Apparatus as in claim 6, wherein:

the flexible cover is attached to the end member, and includes a flexible band attached to the cover adjacent the support member and extending from the cover to wrap around the tree trunk, so as to maintain the cover in place from the end member to the support member.

8. Apparatus as in claim 7, wherein:

the spacing between the side members when interconnected at the proximal ends is somewhat less than the corersponding width of the flexible cover, so that the cover has marginal sides which extend from one side of the cover and over the side members; and further comprising means selectively connecting the marginal sides to the under side of the cover, thereby maintaining the cover stretched on the side members and permitting detachment of the cover from the side members preparatory to pivoting the side members substantially alongside the end member, whereupon the flexible cover can wrap around the end member and adjacent side members for compact storage when not in use.

9. Apparatus as in claim 6, wherein:

said support member comprises a first member telescopically interconnected in selectively fixed extensible relation with a second member;

the first and second members each having an end laterally open to receive a corresponding side member, so as to permit removing the support member from the side members when pivoting the side members to lie substantially alongside the end member; and means associated with said ends of the first and second members to selectively secure the members to the corresponding side members, thereby affixing the support member to the side members at said selectively variable distance from the interconnected proximal ends of the side members.

* * * * *